US010520197B2

(12) United States Patent
Dziech et al.

(10) Patent No.: US 10,520,197 B2
(45) Date of Patent: Dec. 31, 2019

(54) SINGLE CAVITY TRAPPED VORTEX COMBUSTOR WITH CMC INNER AND OUTER LINERS

(71) Applicant: General Electric Company, Schenectady, NY (US)

(72) Inventors: Aaron Michael Dziech, Crittenden, KY (US); Megan Elizabeth Scheitlin, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 231 days.

(21) Appl. No.: 15/610,937

(22) Filed: Jun. 1, 2017

(65) Prior Publication Data

US 2018/0347816 A1 Dec. 6, 2018

(51) Int. Cl.

| | |
|---|---|
| ***F23R 3/58*** | (2006.01) |
| ***F23R 3/00*** | (2006.01) |
| ***F23R 3/60*** | (2006.01) |
| ***F23R 3/10*** | (2006.01) |

(52) U.S. Cl.

CPC ..... *F23R 3/58* (2013.01); *F23R 3/002* (2013.01); *F23R 3/007* (2013.01); *F23R 3/10* (2013.01); *F23R 3/60* (2013.01); *F23R 2900/00015* (2013.01); *F23R 2900/00017* (2013.01); *F23R 2900/03042* (2013.01)

(58) Field of Classification Search

CPC .. F23R 3/002; F23R 3/02; F23R 3/007; F23R 3/10; F23R 3/58; F23R 3/60

See application file for complete search history.

(56) References Cited

U.S. PATENT DOCUMENTS

| | | | | |
|---|---|---|---|---|
| 5,265,425 | A | 11/1993 | Howell | |
| 6,286,317 | B1 * | 9/2001 | Burrus | F23R 3/06 60/750 |
| 6,334,298 | B1 | 1/2002 | Aicholtz | |
| 6,397,603 | B1 * | 6/2002 | Edmondson | F23R 3/007 60/746 |
| 6,711,900 | B1 | 3/2004 | Patel et al. | |
| 6,851,263 | B2 | 2/2005 | Stumpf et al. | |
| 7,153,054 | B2 | 12/2006 | Arbona | |
| 2006/0042257 | A1 * | 3/2006 | Stastny | F23R 3/50 60/772 |

(Continued)

*Primary Examiner* — Craig Kim

(74) *Attorney, Agent, or Firm* — Dority & Manning, P.A.

(57) ABSTRACT

Combustor assemblies and methods for assembling combustor assemblies are provided. For example, a combustor assembly comprises an annular inner liner and an annular outer linear, each extending generally along an axial direction. The outer liner includes an outer flange extending forward from its upstream end. The combustor assembly also comprises a combustor dome extending between an inner liner upstream end and the outer liner upstream end and including an inner flange extending forward from a radially outermost end of the combustor dome. The inner liner, outer liner, and combustor dome define a combustion chamber therebetween, and the combustor dome and a portion of the outer liner together define an annular cavity of the combustion chamber. The inner and outer flanges define an airflow opening therebetween, and a chute member is positioned within the airflow opening to define an air chute for providing a flow of air to the annular cavity.

20 Claims, 8 Drawing Sheets

(56) References Cited

U.S. PATENT DOCUMENTS

| | | | | |
|---|---|---|---|---|
| 2010/0257864 | A1* | 10/2010 | Prociw ..... | F02C 3/145<br>60/758 |
| 2016/0025342 | A1 | 1/2016 | Erbas-Sen et al. | |
| 2016/0123592 | A1 | 5/2016 | Drake et al. | |

* cited by examiner

FIG. 7—

SINGLE CAVITY TRAPPED VORTEX COMBUSTOR WITH CMC INNER AND OUTER LINERS

FEDERALLY SPONSORED RESEARCH

This invention was made with government support under contract number FA8650-15-D-2501 awarded by the U.S. Department of the Air Force. The government may have certain rights in the invention.

FIELD

The present subject matter relates generally to propulsion system combustion assemblies. More particularly, the present subject matter relates to trapped vortex combustor assemblies.

BACKGROUND

More commonly, non-traditional high temperature composite materials, such as ceramic matrix composite (CMC) materials, are being used in applications such as propulsion systems. Components fabricated from CMC materials have a higher temperature capability compared with typical components, e.g., metal components, which may allow improved component performance and/or increased system temperatures. Generally, propulsion systems such as gas turbine engines generally include combustion sections in which compressed air is mixed with a fuel and ignited to generate high pressure, high temperature combustion gases that then flow downstream and expand to drive a turbine section coupled to a compressor section, a fan section, and/or a load device. Conventional combustion sections are challenged to burn a variety of fuels of various caloric values, as well as to reduce emissions, such as nitric oxides, unburned hydrocarbons, and smoke, while also maintaining or improving combustion stability across a wider range of fuel/air ratios, air flow rates, and inlet pressures. Still further, conventional combustion sections are challenged to achieve any or all of these criteria while maintaining or reducing axial and/or radial dimensions and/or part quantities, as well as improving system performance and/or durability.

Therefore, a need exists for a combustion section for a propulsion system that may improve performance and/or durability of the combustion section components, as well as the system, while also reducing combustion section dimensions and allowing a wider range of positions of a combustor assembly within the system.

BRIEF DESCRIPTION

Aspects and advantages of the invention will be set forth in part in the following description, or may be obvious from the description, or may be learned through practice of the invention.

In one exemplary embodiment of the present subject matter, a combustor assembly is provided. The combustor assembly comprises an annular inner liner extending generally along an axial direction and an annular outer liner extending generally along the axial direction. The outer liner includes an outer flange extending forward from an upstream end of the outer liner. The combustor assembly also comprises a combustor dome extending between an upstream end of the inner liner and the upstream end of the outer liner. The combustor dome includes an inner flange extending forward from a radially outermost end of the combustor dome. The inner liner, the outer liner, and the combustor dome define a combustion chamber therebetween, and the combustor dome and a portion of the outer liner together define an annular cavity of the combustion chamber. Moreover, the inner flange and the outer flange define an airflow opening therebetween. The combustor assembly further comprises a chute member that is positioned within the airflow opening to define an air chute for providing a flow of air to the annular cavity.

In another exemplary embodiment of the present subject matter, a combustor assembly is provided. The combustor assembly comprises an annular inner liner extending generally along an axial direction and including an inner flange extending forward from an upstream end of the inner liner. The combustor assembly further comprises an annular outer liner extending generally along the axial direction and a combustor dome extending between the upstream end of the inner liner and an upstream end of the outer liner and including an outer flange extending forward from a radially innermost end of the combustor dome. The inner liner, the outer liner, and the combustor dome define a combustion chamber therebetween, and the combustor dome and a portion of the inner liner together define an annular cavity of the combustion chamber. The inner flange and the outer flange define an airflow opening therebetween. Further, the inner flange defines a first protrusion within the airflow opening, the outer flange defines a second protrusion within the airflow opening opposite the first protrusion, and the first and second protrusions define an air chute for providing a flow of air to the annular cavity.

In a further exemplary embodiment of the present subject matter, a method for assembling a combustor assembly of a gas turbine engine is provided. The method comprises inserting an annular inner liner within the gas turbine engine and inserting an annular outer liner within the gas turbine engine. The inner liner includes an inner flange extending forward from an upstream end of the inner liner. The outer liner circumferentially surrounds the inner liner and includes an outer flange extending forward from an upstream end of the outer liner. The inner liner and the outer liner define a combustion chamber therebetween. The combustion chamber has an annular cavity, and the inner flange and the outer flange define an airflow opening therebetween for providing a flow of air to the annular cavity of the combustion chamber. The method also comprises positioning a chute member within the airflow opening to define an air chute for generating a vortex of air within the annular cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
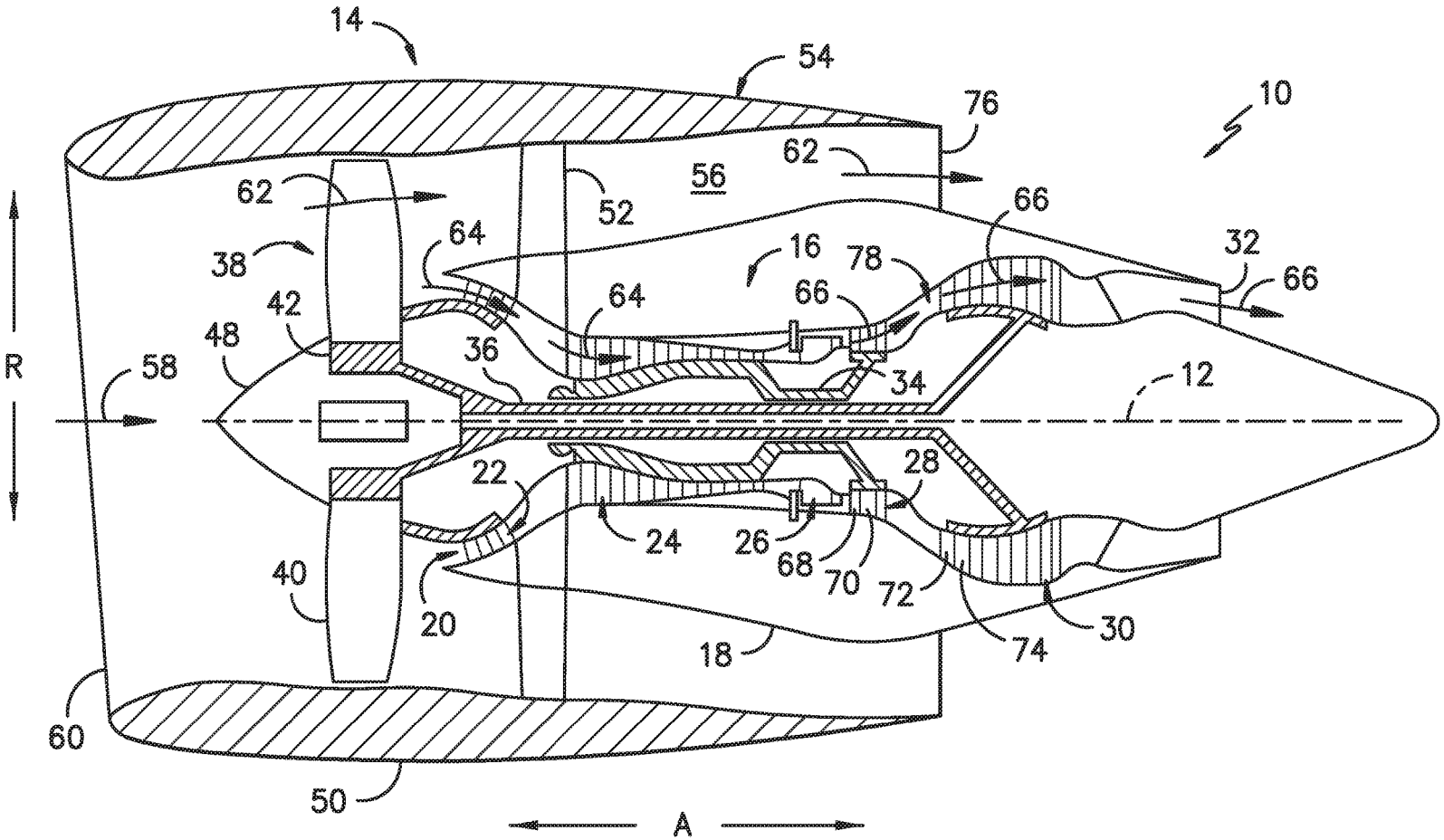
FIG. 1 provides a schematic cross-section view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows and "downstream" refers to the direction to which the fluid flows.

Generally, a single cavity trapped vortex combustor (TVC) for a propulsion system is provided that may improve the performance and/or durability of the propulsion system while also reducing combustion section dimensions. The single cavity TVC shown and described herein may provide high combustor heat release in a short, compact package (e.g., reduced axial and/or radial dimensions). The single cavity TVC may provide a wide range of fuel/air ratios with single sheltered cavity fuel/air mixing and with or without bulk swirl introduction. Further, manufacturability of the single cavity TVC may be improved over conventional TVC, annular, can-annular, or can combustors, thereby improving cost and maintainability. Still further, the single cavity TVC provided herein may allow more freedom to move and/or rotate the combustor within the propulsion system, which may result in higher natural frequencies of the combustor assembly, as well as a lower weight of the propulsion system due to better packaging of the combustor within the system.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference) and a radial direction R. In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22. In other embodiments of turbofan engine 10, additional spools may be provided such that engine 10 may be described as a multi-spool engine.

For the depicted embodiment, fan section 14 includes a fan 38 having a plurality of fan blades 40 coupled to a disk 42 in a spaced apart manner. As depicted, fan blades 40 extend outward from disk 42 generally along the radial direction R. The fan blades 40 and disk 42 are together rotatable about the longitudinal axis 12 by LP shaft 36. In some embodiments, a power gear box having a plurality of gears may be included for stepping down the rotational speed of the LP shaft 36 to a more efficient rotational fan speed.

Referring still to the exemplary embodiment of FIG. 1, disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters turbofan 10 through an associated inlet 60 of the nacelle 50 and/or fan section 14. As the volume of air 58 passes across fan blades 40, a first portion of the air 58 as indicated by arrows 62 is directed or routed into the bypass airflow passage 56 and a second portion of the air 58 as indicated by arrows 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

It will be appreciated that, although described with respect to turbofan 10 having core turbine engine 16, the present subject matter may be applicable to other types of turbomachinery. For example, the present subject matter may be suitable for use with or in turboprops, turboshafts, turbojets, industrial and marine gas turbine engines, and/or auxiliary power units.

Figure 2:
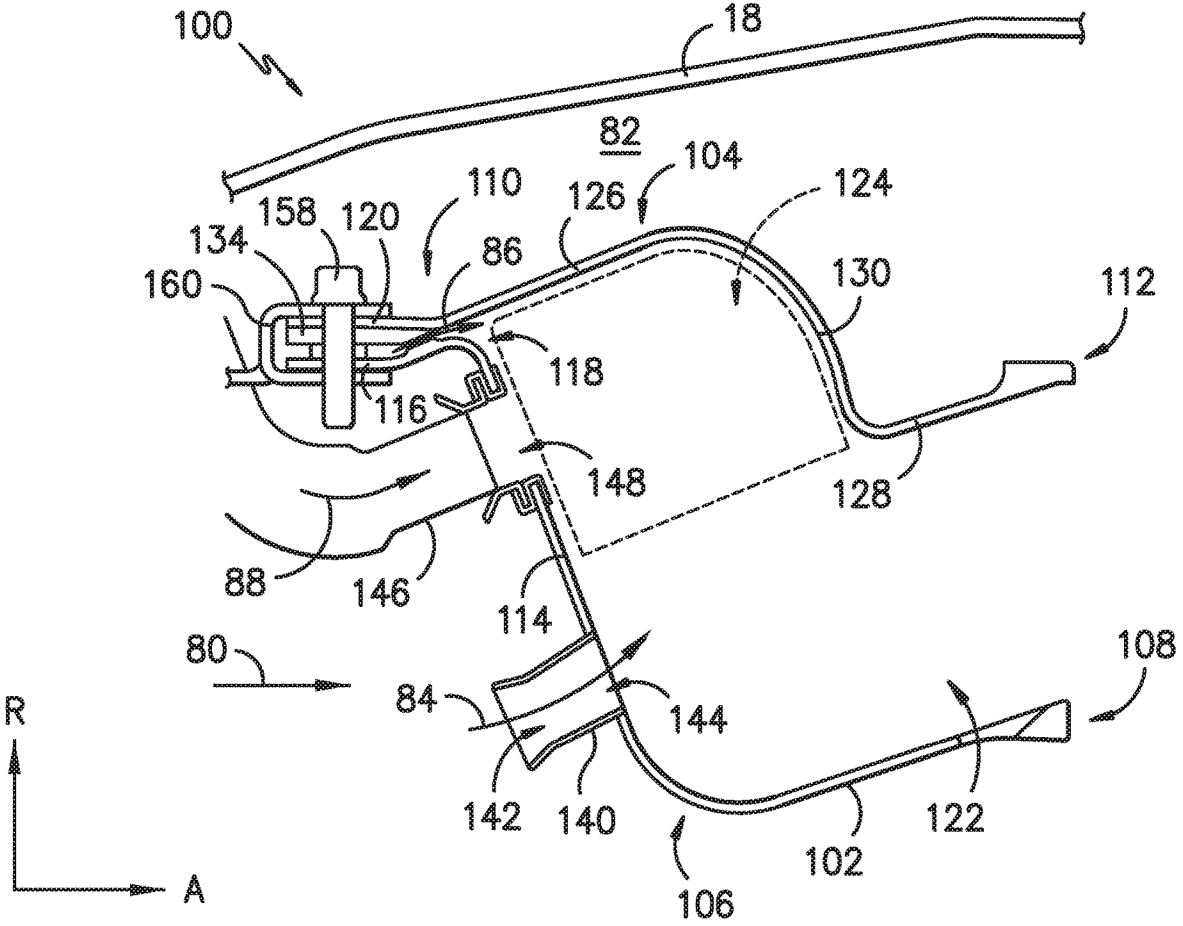
FIG. 2 provides a schematic cross-sectional view of a combustor assembly, e.g., for use in the gas turbine engine of FIG. 1, according to an exemplary embodiment of the present subject matter.

FIG. 2 provides a schematic cross-sectional view of a combustor assembly 100, e.g., for use in the gas turbine engine of FIG. 1, according to an exemplary embodiment of the present subject matter. As shown in FIG. 2, the combustor assembly 100 comprises an annular inner liner 102 and an annular outer liner 104. The inner liner 102 extends generally along the axial direction A between an upstream end 106 and a downstream end 108. Similarly, the outer liner 104 extends generally along the axial direction A between an upstream end 110 and a downstream end 112.

A combustor dome 114 extends generally along the radial direction R between the upstream end 106 of the inner liner 102 and the upstream end 110 of the outer liner 104. The combustor dome 114 includes an inner flange 116 that extends forward from a radially outermost end 118 of the combustor dome. The outer liner 104 also includes an outer flange 120 that extends forward from the upstream end 110 of the outer liner 104. In the depicted embodiment of FIG. 2, the combustor dome 114 is integral with the inner liner 102, i.e., the inner liner 102 and the combustor dome 114 are integrally formed as a single piece structure. For instance, the combustor dome 114 may be integrally formed with the inner liner 102 from a CMC material. In other embodiments, the combustor dome 114 is formed separately from the inner liner 102 and the outer liner 104 and may be formed from, e.g., a metallic material such as a metal or metal alloy, as described in greater detail with respect to FIGS. 6 and 7.

As shown in FIG. 2, the inner liner 102, the outer liner 104, and the combustor dome 114 define a combustion chamber 122 therebetween. Further, the combustor dome 114 and a portion of the outer liner 104 together define an annular cavity 124 of the combustion chamber 122. More particularly, the outer liner 104 includes a first wall 126 extending at least partially along the axial direction A and a second wall 128 extending at least partially along the axial direction A. The outer liner 104 further includes a transition wall 130 extending from the first wall 126 to the second wall 128, thereby coupling the first wall 126 and the second wall 128. As illustrated in FIG. 2, the first wall 126 is disposed radially outward of the second wall 128 or, stated differently, the second wall 128 is disposed radially inward of the first wall 126. The combustor dome 114, the first wall 126, and the transition wall 130 together define the annular cavity 124 of the combustion chamber 122.

Figure 3:
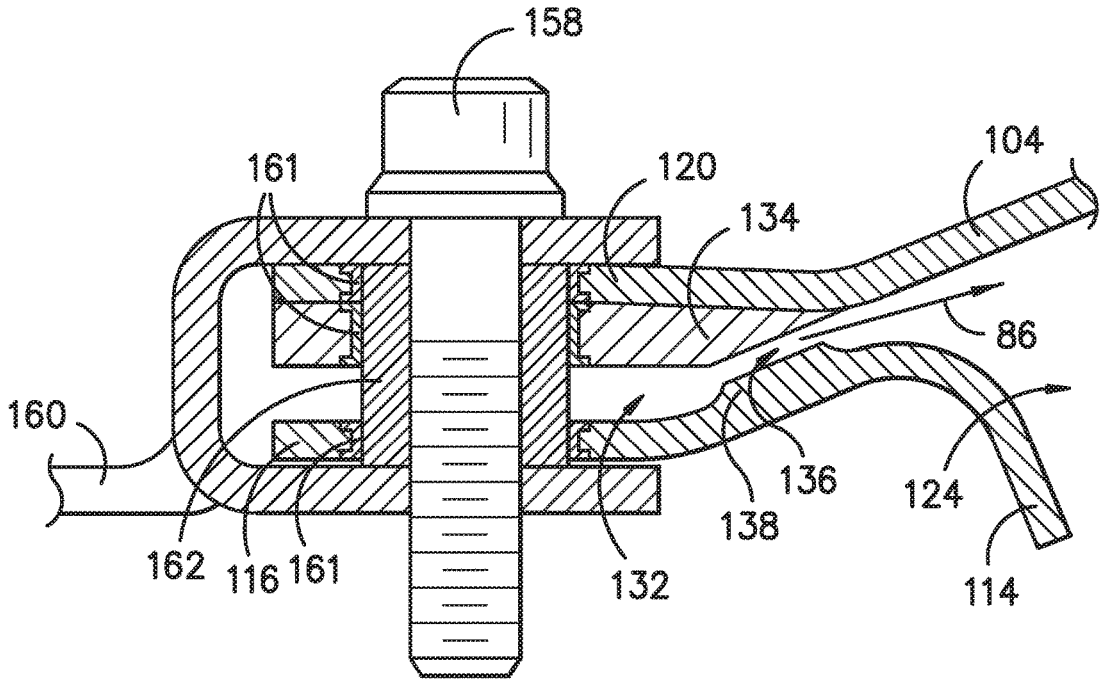
FIG. 3 provides a close-up view of a portion of the combustor assembly cross-section of FIG. 2.

Referring now to FIG. 3, a close-up view is provided of the inner and outer flanges 116, 120. In the exemplary embodiment of the combustor assembly 100 depicted in FIGS. 2 and 3, the inner flange 116 and the outer flange 120 define an airflow opening 132 therebetween. The airflow opening 132 provides a flow of air, indicated schematically by arrows 86, to the annular cavity 124 of the combustion chamber 122. In the depicted embodiment, a chute member 134 is positioned within the airflow opening 132 to define an air chute 136 for providing the flow of air 86 to the annular cavity 124. More particularly, the air chute 136 helps provide the flow of air 86 in a manner to generate a vortex effect within the annular cavity 124, as described in greater detail herein. In some embodiments, the chute member 134 is a single piece, annular structure, but in other embodiments, the chute member 134 comprises a plurality of chute member segments that together form an annular chute member 134. The chute member 134, whether formed as a single piece or from a plurality of segments, is formed from any suitable material, e.g., a CMC material.

Further, the inner flange 116 defines a protrusion 138 within the airflow opening 132. The protrusion 138 is opposite the chute member 134 such that the protrusion 138 and the chute member 134 together define the air chute 136. As described in more detail herein, the protrusion 138 may be machinable to help control the width W of the air chute 136 and thereby control the vortex effect in the annular cavity 124 generated by the flow of air 86 through the air chute 136.

Additionally, an attachment member 158 may extend through the outer flange 120, the chute member 134, and the inner flange 116 to hold these components in position with respect to one another. The attachment member 158 may be a bolt, pin, or other suitable fastener. Further, the attachment member 158 also may attach the outer flange 120, chute member 134, and inner flange 116 to a support structure 160. The support structure 160 helps support the combustor assembly 100 within the combustion section 26 of the gas turbine engine 10. Moreover, each of the outer flange 120, chute member 134, and inner flange 116 includes a grommet 161, which helps these components move radially along a bushing 162 positioned over the attachment member 158 while preventing or reducing wear on the components, as well as binding of the components. The grommets 161 may be particularly useful where the inner and outer liners 102, 104 and the chute member 134 are each formed from a CMC material, as described in greater detail below. Each grommet 161 may include a spotface (not shown) that helps keep the grommets 161 from hitting or contacting one another as the components move radially with respect to one another and the attachment member 158. The attachment assembly, e.g., attachment member 158, grommets 161, and bushing 162, may help maintain the chute member 134 in a proper position during assembly of the combustor assembly 100 and engine operation.

Figure 4:
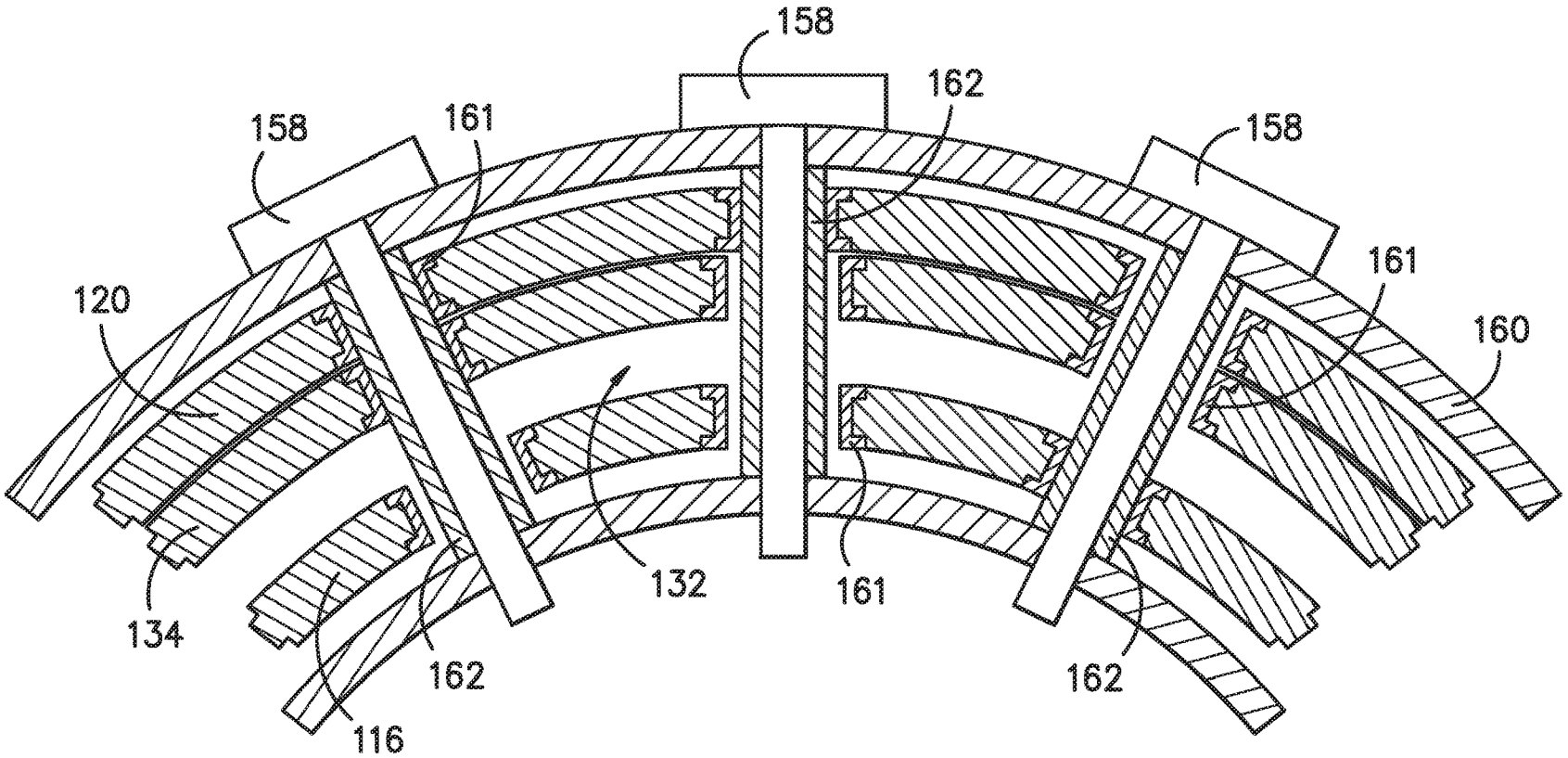
FIG. 4 provides a circumferential cross-section view of the portion of the combustor assembly illustrated in FIG. 3, according to an exemplary embodiment of the present subject matter.

Turning now to FIG. 4, a circumferential cross-section view is provided of the portion of the combustor assembly illustrated in FIG. 3, according to an exemplary embodiment of the present subject matter. As depicted in FIG. 4, a plurality of attachment members 158, a plurality of bushings 162, and a plurality of grommets 161 are used to hold the outer flange 120, chute member 134, and inner flange 116 in position with respect to one another. The plurality of attachment members 158 may be spaced apart from one another along the circumferential direction C, with one of the plurality of bushings 162 positioned over each attachment member 158 and a grommet 161 at each aperture in the outer flange 120, the chute member 134, and the inner flange 116. The attachment members 158 separately support the inner and outer liners 102, 104, and one attachment member 158 may support the inner liner 102 or outer liner 104 while an adjacent attachment member 158 may support the other of the inner and outer liners 102, 104. That is, each attachment member 158 may support only one of the inner and outer liners 102, 104, and adjacent attachment members 158 may or may not support the same liner.

As shown in FIG. 4, a grommet 161 may be tight against the bushing 162 or the grommet 161 may be loose with respect to the bushing 162. The grommets 161 used with the outer flange 120 may alternate between tight and loose with respect to the bushings 162; similarly, the grommets 161 used with the chute member 134 and the grommets 161 used with the inner flange 116 may alternate between tight and loose with respect to the bushings 162. In the exemplary embodiment illustrated in FIG. 4, the rightmost outer flange grommet 161 is loose with respect to the rightmost bushing 162, while the other two illustrated outer flange grommets 161 are tight with respect to the other two illustrated bushings 162. Further, the leftmost chute member grommet 161 is tight with respect to the leftmost bushing 162, while the remaining two illustrated chute member grommets 161 are loose with respect to the remaining two illustrated bushings 162. Moreover, the rightmost inner flange grommet 161 is tight with respect to the rightmost bushing 162, while the other two illustrated inner flange grommets 161 are loose with respect to the remaining two bushings 162.

The pattern illustrated in FIG. 4 with respect to a portion of the inner and outer flanges 116, 120 and the chute member 134 may be repeated about the circumference of the combustor assembly 100. More particularly, the outer flange grommets 161 may have a repeating pattern of two tight grommets 161 and one loose grommet 161; the chute member grommets 161 may have a repeating pattern of one tight grommet 161 and two loose grommets 161; and the inner flange grommets 161 may have a repeating pattern of two loose grommets 161 and one tight grommet 161. However, other patterns may be used as well. As one example, the inner flange grommets 161 may have a repeating pattern of two tight grommets 161 and one loose grommet 161; the outer flange grommets 161 may have a repeating pattern of two loose grommets 161 and one tight grommet 161; and the chute member grommets 161 may follow the same pattern as the outer flange grommets 161, i.e., a repeating pattern of two loose grommets 161 and one tight grommet 161. As another example, the grommets 161 may alternate in a 1:1 ratio of tight to loose grommets, with the chute member grommet 161 of a respective attachment member 158 having the same configuration as the outer flange grommet 161 of that attachment member 158 and the inner flange grommet 161 having the opposite configuration. That is, the outer flange 120 and the chute member 134 may both be tight to the attachment member 158 while the inner flange 116 is loose with respect to that attachment member 158; for the adjacent attachment member 158, the outer flange 120 and chute member 134 are loose while the inner flange 116 is tight.

Referring back to FIG. 2, the combustor assembly 100 further includes an airflow tube 140 extending generally along the axial direction A and coupled to the combustor dome 114. The airflow tube 140 extends into or through an opening in the combustor dome 114 radially inward of the second wall 128 and, thus, the annular cavity 124 of the combustion chamber 122. The airflow tube 140 comprises walls defining an inlet opening 142 at an upstream end and an outlet opening 144 at a downstream end, generally positioned at the opening in the combustor dome 114. The outlet opening 144 may be a generally round orifice, such as, but not limited to, a circular, ovular, or generally oblong orifice; a polygonal orifice; or any other suitably shaped orifice.

In some embodiments, the airflow tube 140 extends at least partially along the circumferential direction C, e.g., at an angle or as a serpentine structure, to induce a circumferential swirl of air through the airflow tube 140 into the combustion chamber 122. In other embodiments, the airflow tube 140 defines a generally straight or longitudinal passage to induce a straight flow or non-swirl of air through the airflow tube 140 into the combustion chamber 122. In any event, the airflow tube 140 provides air to the combustion chamber 122 radially inward of the annular cavity 124, and the air provided by the airflow tube 140 may be referred to as dilution air, which mixes with the vortex generated in the annular cavity 124 as described in greater detail below.

Additionally, the combustor assembly 100 includes a fuel nozzle 146 defining a fuel nozzle outlet 148. In the exemplary embodiment depicted in FIG. 2, the fuel nozzle 146 is disposed through the combustor dome 114 such that the fuel nozzle outlet 148 is disposed adjacent the annular cavity 124 of the combustion chamber 122. More particularly, the fuel nozzle 146 is radially disposed between the first wall 126 and the second wall 128, i.e., the fuel nozzle 146 is disposed radially inward with respect to first wall 126 and radially outward with respect to second wall 128. Accordingly, fuel provided through the fuel nozzle 146 may mix in the annular cavity 124 with the flow of air 86 provided through the air chute 136.

As previously described, during operation of the engine 10 a portion of air, indicated by arrows 64 in FIG. 1, is progressively compressed as it flows through the LP and HP compressors 22, 24 toward the combustion section 26. As shown in FIG. 2, the now compressed air, indicated schematically by arrows 80, flows into a pressure plenum 82 generally surrounding the combustion chamber 122 of the combustion section 26. The compressed air 80 flows around and through the pressure plenum 82 and into the combustion chamber 122 through the airflow tube 140, as shown schematically by arrows 84, and through the airflow opening 132, as indicated by arrows 86. A fuel, such as a liquid or gaseous fuel shown schematically by arrows 88, flows through the fuel nozzle 146 and into the annular cavity 124 of the combustion chamber 122. The fuel 88 and the air 86 mix and ignite within the annular cavity 124 of the combustion chamber 122. The fuel 88 through the fuel nozzle 146 and air 86 through the airflow opening 132 and air chute 136 generally mix and generate a vortex within the annular cavity 124 in which the fuel 88 and air 86 ignite, expand, and generally recirculate within the annular cavity 124 as a generally uniform fuel/air mixture, thereby reducing undesired emissions in the combustion gases 66.

The air 84 through the airflow tube 140 may then flow the combustion gases 66 from the fuel/air mixture within the annular cavity 124 through the combustion chamber 122 and further downstream into the turbine section. The combustion gases 66 generated in the combustion chamber 122 flow from the combustor assembly 100 into the HP turbine 28, thus causing the HP rotor shaft 34 to rotate, which supports operation of the HP compressor 24 as previously described. As shown in FIG. 1, the combustion gases 66 then are routed through the LP turbine 30, causing the LP rotor shaft 36 to rotate and thereby supporting operation of the LP compressor 22 and/or rotation of the fan shaft. The combustion gases 66 are then exhausted through the jet exhaust nozzle section 32 of the core engine 16 to provide propulsive thrust.

Figure 5:
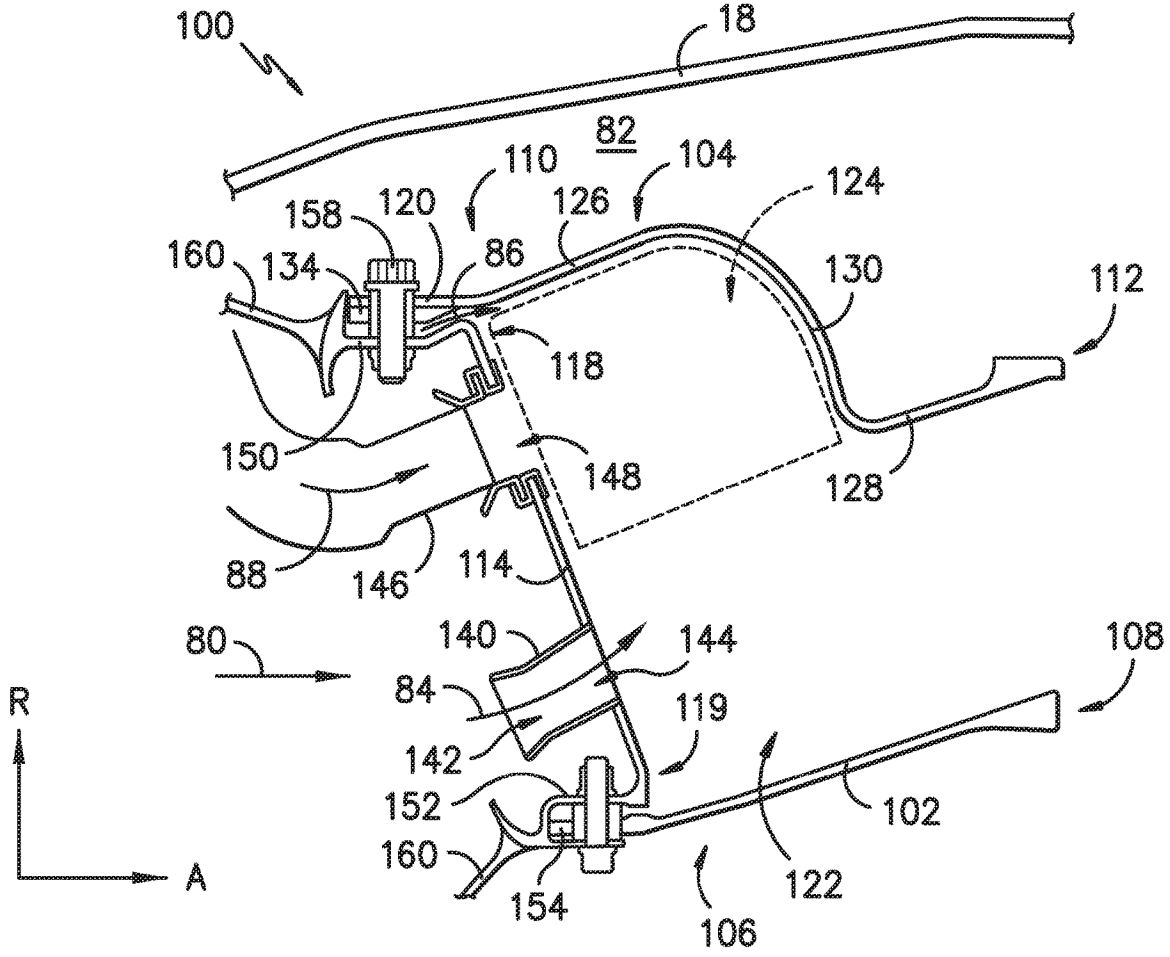
FIG. 5 provides a schematic cross-sectional view of a combustor assembly, e.g., for use in the gas turbine engine of FIG. 1, according to an exemplary embodiment of the present subject matter.

FIG. 5 provides a schematic cross-sectional view of the combustor assembly 100 having a separate combustor dome 114, according to another exemplary embodiment of the present subject matter. As previously described, the combustor dome 114 may be integral with the inner liner 102, as shown in FIG. 2, or may be separate from both the inner liner 102 and the outer liner 104, as shown in FIG. 5. In still other embodiments, described in greater detail below, the combustor dome may be integral with the outer liner. In any event, the embodiment depicted in FIG. 5 illustrates a combustor dome 114 formed separately from the inner and outer liners 102, 104. The separate combustor dome 114 shown in FIG. 5 may be formed from a metallic material, such as a metal or metal alloy, or may be formed from any other suitable material, such as a CMC material or the like.

Similar to the embodiment depicted in FIGS. 2 and 3, the combustor dome 114 shown in FIG. 5 includes a first flange 150 that extends forward from a radially outermost end 118 of the combustor dome. The combustor dome 114 also includes a second flange 152 that extends forward from a radially innermost end 119 of the combustor dome. The first flange 150 is coupled to the outer flange 120 extending from the outer liner 104, and the second flange 152 is coupled to an inner flange 154 extending from the upstream end 106 of the inner liner 102.

Figure 6:
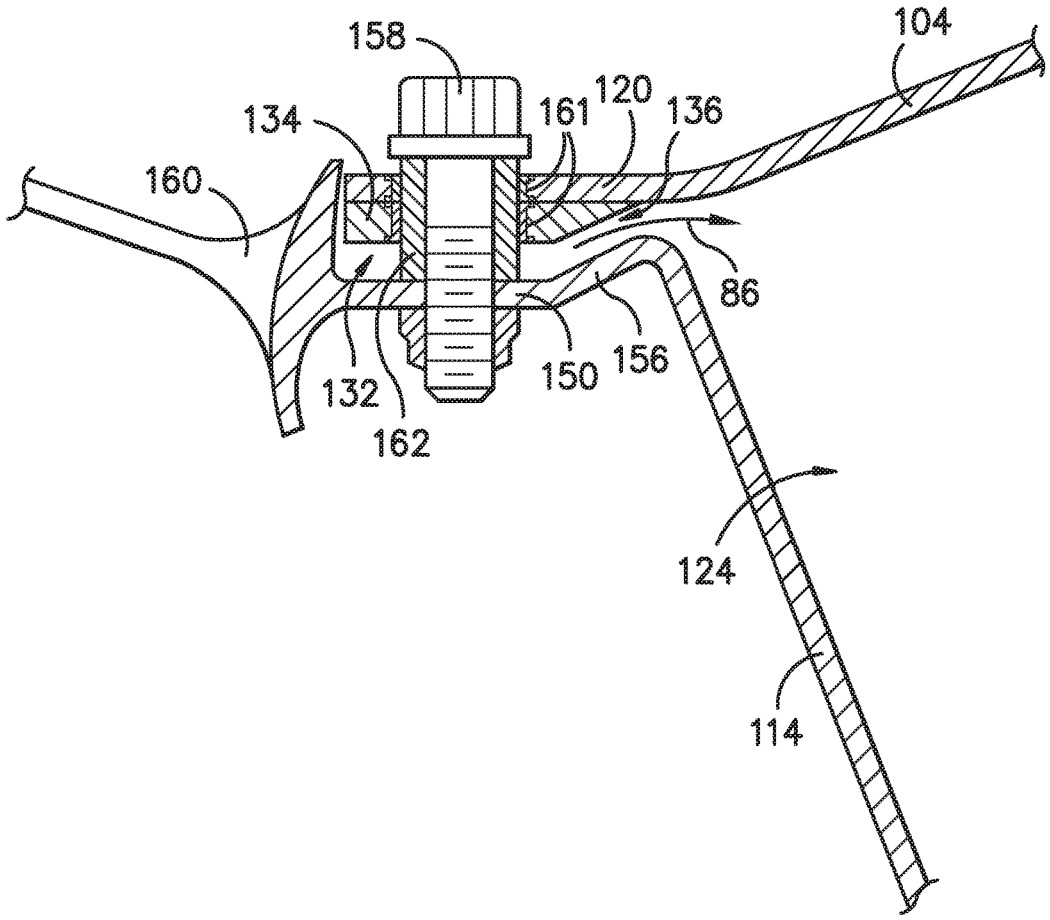
FIG. 6 provides a close-up view of a portion of the combustor assembly cross-section of FIG. 5.

Referring now to FIG. 6, a close-up view is provided of the outer flange 120 and first flange 150. In the exemplary embodiment of the combustor assembly 100 depicted in FIGS. 4 and 5, the outer flange 120 and first combustor dome flange 150 define the airflow opening 132 therebetween. As described with respect to FIGS. 2 and 3, an airflow opening 132 provides a flow of air, indicated schematically by arrows 86, to the annular cavity 124 of the combustion chamber 122. As depicted in FIGS. 4 and 5, a chute member 134 is positioned within the airflow opening 132 to define an air chute 136 for providing the flow of air 86 to the annular cavity 124. More particularly, the air chute 136 helps provide the flow of air 86 in a manner to generate a vortex effect within the annular cavity 124, as described in greater detail herein. In some embodiments, the chute member 134 is a single piece, annular structure, but in other embodiments, the chute member 134 comprises a plurality of chute member segments that together form an annular chute member 134. The chute member 134, whether formed as a single piece or from a plurality of segments, is formed from any suitable material, e.g., a CMC material. An attachment member 158 extends through the outer flange 120, the chute member 134, and the first flange 150 to hold these components in position with respect to one another and to attach the chute member 134 and flanges 120, 150 to a support structure 160. Another attachment member 158 extends through the inner flange 154 and the second flange 152 to hold these components in position with respect to one another and to attach the flanges 152, 154 to a support structure 160. Grommets 161 are included on the outer flange 120 and chute member 134, and a bushing 162 is positioned about the attachment member 158, as described above with respect to FIGS. 3 and 4.

However, unlike the embodiment of FIGS. 2 and 3, the first flange 150 does not include a protrusion 138. Rather, the first flange 150 includes an angled portion 156 opposite the chute member 134 such that the angled portion 156 and the chute member 134 together define the air chute 136. The angled portion 156 is angled with respect to the first flange 150, which extends generally along the axial direction A in the depicted embodiment. The angle of the angled portion 156 relative to the first flange 150 may be selected to help control the width W of the air chute 136 and thereby control the vortex effect in the annular cavity 124 generated by the flow of air 86 through the air chute 136. The combustor assembly 100 may be otherwise configured similarly to the embodiment of FIGS. 2 and 3, such that fuel 88 and air 86 mix and ignite within the annular cavity 124 of the combustion chamber 122, and the resulting combustion gases 66 are flowed from the annular cavity 124 via the air 84 through airflow tube 140, as previously described.

Figure 7:
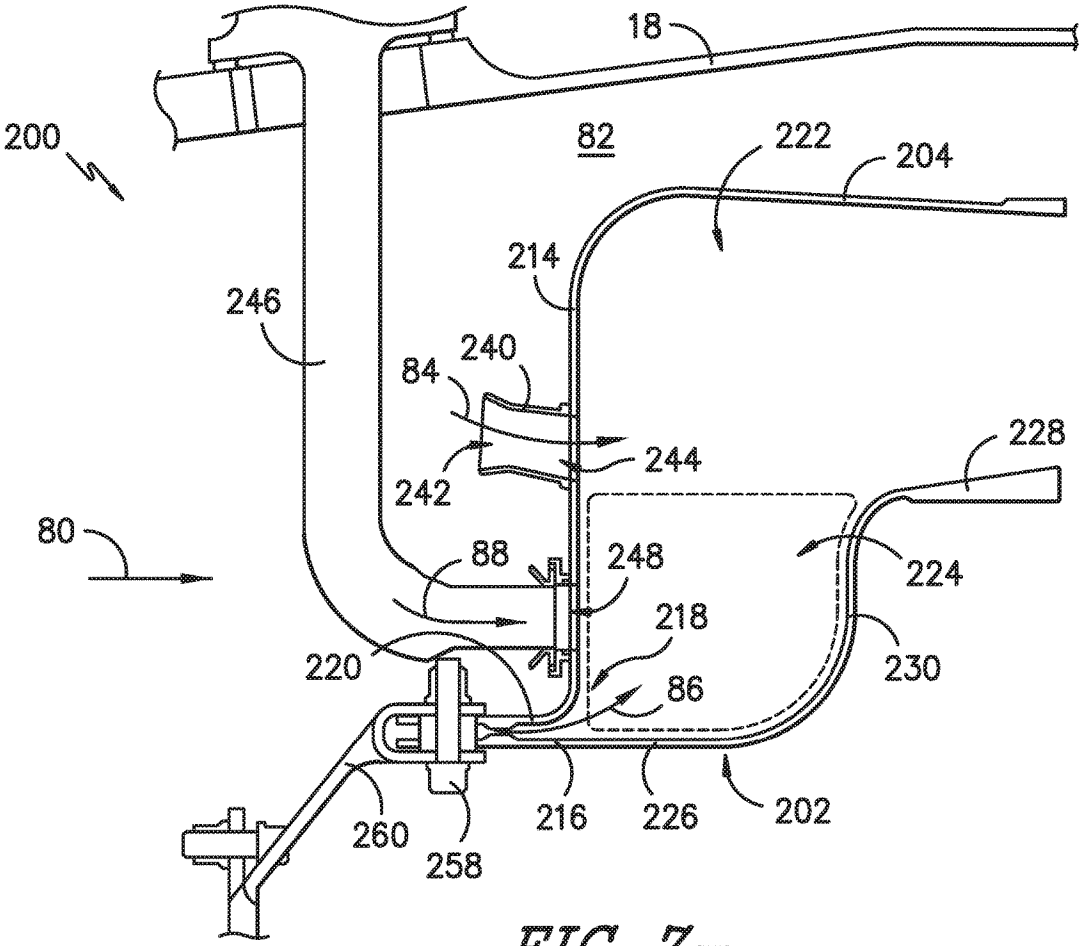
FIG. 7 provides a schematic cross-sectional view of a combustor assembly, e.g., for use in the gas turbine engine of FIG. 1, according to an exemplary embodiment of the present subject matter.

FIG. 7 provides a schematic cross-sectional view of a combustor assembly 200, e.g., for use in the gas turbine engine of FIG. 1, according to another exemplary embodiment of the present subject matter. As further described below, the combustor assembly 200 generally is the inverse or opposite configuration of the exemplary combustor assembly 100 illustrated in FIGS. 2 and 3. As shown in FIG. 7, the combustor assembly 200 comprises an annular inner liner 202 and an annular outer liner 204. The inner liner 202 extends generally along the axial direction A between an upstream end 206 and a downstream end 208. Similarly, the outer liner 204 extends generally along the axial direction A between an upstream end 210 and a downstream end 212.

A combustor dome 214 extends generally along the radial direction R between the upstream end 206 of the inner liner 202 and the upstream end 210 of the outer liner 204. The combustor dome 214 includes an outer flange 220 that extends forward from a radially innermost end 218 of the combustor dome. The inner liner 202 also includes an inner flange 216 that extends forward from the upstream end 206 of the inner liner 202. In the depicted embodiment of FIG. 7, the combustor dome 214 is integral with the outer liner 204, i.e., the outer liner 204 and the combustor dome 214 are integrally formed as a single piece structure. For instance, the combustor dome 214 may be integrally formed with the outer liner 204 from a CMC material. In other embodiments, the combustor dome 214 is formed separately from the inner liner 202 and the outer liner 204 and may be formed from, e.g., a metallic material such as a metal or metal alloy.

As shown in FIG. 7, the inner liner 202, the outer liner 204, and the combustor dome 214 define a combustion chamber 222 therebetween. Further, the combustor dome 214 and a portion of the inner liner 202 together define an annular cavity 224 of the combustion chamber 222. More particularly, the inner liner 202 includes a first wall 226 extending at least partially along the axial direction A and a second wall 228 extending at least partially along the axial direction A. The inner liner 202 further includes a transition wall 230 extending from the first wall 226 to the second wall 228, thereby coupling the first wall 226 and the second wall 228. As illustrated in FIG. 5, the first wall 226 is disposed radially inward of the second wall 228 or, stated differently, the second wall 228 is disposed radially outward of the first wall 226. The combustor dome 214, the first wall 226, and the transition wall 230 together define the annular cavity 224 of the combustion chamber 222.

Figure 8:
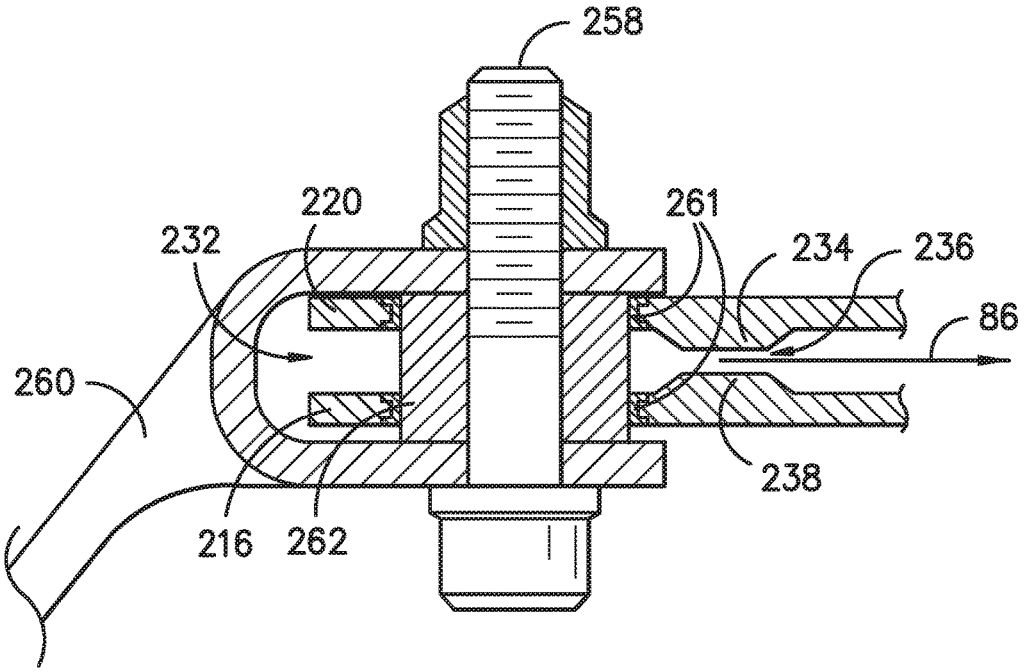
FIG. 8 provides a close-up view of a portion of the combustor assembly cross-section of FIG. 7.

Referring now to FIG. 8, a close-up view is provided of the inner and outer flanges 216, 220. In the exemplary embodiment of the combustor assembly 200 depicted in FIGS. 6 and 7, the inner flange 216 and the outer flange 220 define an airflow opening 232 therebetween. The airflow opening 232 provides a flow of air, indicated schematically by arrows 86, to the annular cavity 224 of the combustion chamber 222. In the depicted embodiment, the inner flange 216 defines a first protrusion 234 within the airflow opening 232, and the outer flange defines a second protrusion 238 within the airflow opening 232 opposite the first protrusion 234. The first and second protrusions 234, 238 define an air chute 236 for providing the flow of air 86 to the annular cavity 224. More particularly, the air chute 236 helps provide the flow of air 86 in a manner to generate a vortex effect within the annular cavity 224, as described in greater detail herein. Further, the first and second protrusions 234, 238 may be machinable, as described in greater detail herein, to help control the width W of the air chute 236 and thereby control the vortex effect in the annular cavity 224 generated by the flow of air 86 through the air chute 236.

Additionally, an attachment member 258 may extend through the inner flange 216 and the outer flange 220 to hold these components in position with respect to one another. The attachment member 258 may be a bolt, pin, or other suitable fastener. Further, the attachment member 258 also may attach the inner and outer flanges 216, 220 to a support structure 260 that, e.g., helps support the combustor assembly 200 within the combustion section 26 of the gas turbine engine 10. Moreover, each of the outer flange 220 and inner flange 216 includes a grommet 261, which helps the flanges move radially along a bushing 262 positioned over the attachment member 258 while preventing or reducing wear on and binding of the flanges. As described with respect to the embodiment shown in FIGS. 3 and 4, the grommets 261 may be particularly useful where the inner and outer liners 202, 204 are each formed from a CMC material. Each grommet 261 may include a spotface (not shown) that helps keep the grommets 261 from hitting or contacting one another as the components move radially with respect to one another and the attachment member 258. The attachment assembly, e.g., the attachment member 258, grommets 261, and bushing 262, may help maintain the inner and outer flanges 216, 220 in a proper position with respect to one another during assembly of the combustor assembly 200 and engine operation. Further, the combustor assembly 200 preferably includes a plurality of attachment members 258 and grommets 261, and the grommets 261 used with the inner and outer flanges 216, 220 may alternate between being tight and loose with respect to the attachment members 258 in any one of a number of patterns as described above with respect to the embodiment of FIG. 4.

Referring back to FIG. 7, the combustor assembly 200 further includes a airflow tube 240 extending generally along the axial direction A and coupled to the combustor dome 214. The airflow tube 240 extends into or through an opening in the combustor dome 214 radially outward of the second wall 228 and, thus, the annular cavity 224 of the combustion chamber 222. The airflow tube 240 comprises walls defining an inlet opening 242 at an upstream end and an outlet opening 244 at a downstream end, generally positioned at the opening in the combustor dome 214. The outlet opening 244 may be a generally round orifice, such as, but not limited to, a circular, ovular, or generally oblong orifice; a polygonal orifice; or any other suitably shaped orifice.

In some embodiments, the airflow tube 240 extends at least partially along the circumferential direction C, e.g., at an angle or as a serpentine structure, to induce a circumferential swirl of air through the airflow tube 240 into the combustion chamber 222. In other embodiments, the airflow tube 240 defines a generally straight or longitudinal passage to induce a straight flow or non-swirl of air through the airflow tube 240 into the combustion chamber 222. In any event, the airflow tube 240 provides air to the combustion chamber 222 radially inward of the annular cavity 224, and the air provided by the airflow tube 240 may be referred to as dilution air, which mixes with the vortex generated in the annular cavity 224 as described in greater detail below.

Additionally, the combustor assembly 200 includes a fuel nozzle 246 defining a fuel nozzle outlet 248. In the exemplary embodiment depicted in FIG. 7, the fuel nozzle 246 is disposed through the combustor dome 214 such that the fuel nozzle outlet 248 is disposed adjacent the annular cavity 224 of the combustion chamber 222. More particularly, the fuel nozzle 246 is radially disposed between the first wall 226 and the second wall 228, i.e., the fuel nozzle 246 is disposed radially outward with respect to first wall 226 and radially inward with respect to second wall 228. Accordingly, fuel provided through the fuel nozzle 246 may mix in the annular cavity 224 with the flow of air 86 provided through the air chute 236.

As previously described, during operation of the engine 10 a portion of air, indicated by arrows 64 in FIG. 1, is progressively compressed as it flows through the LP and HP compressors 22, 24 toward the combustion section 26. As shown in FIG. 7, the now compressed air, indicated schematically by arrows 80, flows into a pressure plenum 82 generally surrounding the combustion chamber 222 of the combustion section 26. The compressed air 80 flows around and through the pressure plenum 82 and into the combustion chamber 222 through the airflow tube 240, as shown schematically by arrows 84, and through the airflow opening 232, as indicated by arrows 86. A fuel, such as a liquid or gaseous fuel shown schematically by arrows 88, flows through the fuel nozzle 246 and into the annular cavity 224 of the combustion chamber 222. As described with respect to the embodiment of FIGS. 2 and 3, the fuel 88 and the air 86 mix and ignite within the annular cavity 224 of the combustion chamber 222. The fuel 88 through the fuel nozzle 246 and air 86 through the airflow opening 232 and air chute 236 generally mix and generate a vortex within the annular cavity 224 in which the fuel 88 and air 86 ignite, expand, and generally recirculate within the annular cavity 224 as a generally uniform fuel/air mixture, thereby reducing undesired emissions in the combustion gases 66.

The air 84 through the airflow tube 240 may then flow the combustion gases 66 from the fuel/air mixture within the annular cavity 224 through the combustion chamber 222 and further downstream into the turbine section. The combustion gases 66 generated in the combustion chamber 222 flow from the combustor assembly 200 into the HP turbine 28, thus causing the HP rotor shaft 34 to rotate, which supports operation of the HP compressor 24 as previously described. As shown in FIG. 1, the combustion gases 66 then are routed through the LP turbine 30, causing the LP rotor shaft 36 to rotate and thereby supporting operation of the LP compressor 22 and/or rotation of the fan shaft. The combustion gases 66 are then exhausted through the jet exhaust nozzle section 32 of the core engine 16 to provide propulsive thrust.

In some embodiments, as most clearly shown in FIG. 2, the combustor assembly may be tilted with respect to the radial direction R, but in other embodiments, as most clearly shown in FIG. 7, the combustor assembly may be generally aligned along the radial direction R. That is, as depicted with respect to the combustor assembly 100, the inner and outer liners of the combustor assembly may be at an angle with respect to the radial direction R. An angled or tilted combustor assembly allows the combustor to be shorter in axial length, as combustion may be condensed in a smaller area than non-angled or non-tilted combustors, which may allow the axial length of the engine in which the combustor assembly is installed to be shorter, thereby lowering the engine weight. Further, the angled or tilted combustor assembly may be better packaged within the engine, which may, e.g., permit a more compact engine (e.g., a shorter engine, a smaller diameter outer casing 18, and/or a smaller engine diameter at its aft end) and increase the combustor assembly packaging options by allowing more versatility in combustor orientation. Additionally, the angled or tilted combustor assembly may be a stiffer structure than a non-tilted or non-angled combustor, with a higher natural frequency, which may improve the life and performance of the combustor assembly.

It will be appreciated that the chute member 134 allows the combustor assembly 100 to be angled or tilted with respect to the radial direction R. More particularly, as further described below, the combustor assembly 100 may be assembled by inserting the inner liner 102 into the gas turbine engine and then inserting the outer liner 104 into the engine such that the outer liner 104 slides over the inner liner 102 to position the outer liner 104 around the inner liner 102. As previously described, the inner liner 102 includes the combustor dome 114, from which the inner flange 116 extends. The inner flange 116 and the outer flange 120, which extends from the outer liner 104, form the airflow opening 132. If the inner flange 116 and the outer flange 120 alone were to define the air chute 136 having a specified width W for supplying air 86 to annular cavity 124 to generate the vortex within the annular cavity 124, it would be difficult, if not impossible, to slide the outer liner 104 over the inner liner 104 to install the components within the engine, due to the small clearance between the inner and outer liners 102, 104 at the air chute 136. Accordingly, by utilizing the chute member 134, which is separate from the inner and outer liners 102, 104, a relatively larger gap (i.e., the airflow opening 132) exists between the inner and outer liners 102, 104, which facilitates installation of the liners within the engine. After the liners 102, 104 are positioned within the engine, the chute member 134 may be installed to define the air chute 136 as previously described.

The present subject matter also encompasses various exemplary methods for assembling a combustor assembly of a gas turbine engine, such as the engine 10 of FIG. 1. For instance, in one exemplary embodiment, a method for assembling the combustor assembly 100 of FIGS. 2 and 3 comprises inserting the annular inner liner 102 within the gas turbine engine and inserting the annular outer liner 104 within the engine. More particularly, because the outer liner 104 circumferentially surrounds the inner liner 102, the outer liner 104 is inserted over the inner liner 102 to install the outer liner 104 within the engine. As described with respect to FIGS. 2 and 3, the inner liner 102 and the outer liner 104 define a combustion chamber 122 therebetween, and the combustion chamber 122 includes an annular cavity 124.

Further, the inner liner 102 includes an inner flange 116 extending forward from an upstream end 106 of the inner liner, and the outer liner 104 includes an outer flange 120 extending forward from an upstream end 110 of the outer liner. The inner and outer flanges 116, 120 define an airflow opening 132 therebetween for providing a flow of air 86 to the annular cavity 124 of the combustion chamber 122. The assembly method also includes positioning a chute member 134 within the airflow opening 132 to define an air chute 136 for generating a vortex of air within the annular cavity 124. As previously described, in some embodiments the chute member 134 is a single piece, annular structure, but in other embodiments, the chute member 134 comprises a plurality of chute member segments that together form an annular chute member 134.

Moreover, in the embodiment of combustor assembly 100 shown in FIGS. 2 and 3, the inner flange 116 defines a protrusion 138 within the airflow opening 132. The exemplary assembly method further comprises machining the protrusion 138 such that the air chute 136 has a predetermined width W. For example, the inner liner 102, which includes combustor dome 114 and inner flange 116, may be formed from a CMC material. The protrusion 138 may be formed from a buildup of CMC plies, e.g., a CMC ply stack or a plurality of CMC plies laid up with the CMC material forming the inner liner 102. The buildup may be machined to define protrusion 138 and/or to define the width W of the air chute 136.

In another exemplary embodiment, a method for assembling the combustor assembly 200 of FIGS. 6 and 7 comprises inserting the annular inner liner 202 within the gas turbine engine and inserting the annular outer liner 204 within the engine. More particularly, because the outer liner 204 circumferentially surrounds the inner liner 202, the outer liner 204 is inserted over the inner liner 202 to install the outer liner 204 within the engine. As described with respect to FIGS. 6 and 7, the inner liner 202 and the outer liner 204 define a combustion chamber 222 therebetween, and the combustion chamber 222 includes an annular cavity 224.

Further, the inner liner 202 includes an inner flange 216 extending forward from an upstream end 206 of the inner liner, and the outer liner 204 includes an outer flange 220 extending forward from an upstream end 210 of the outer liner. The inner and outer flanges 216, 220 define an airflow opening 232 therebetween for providing a flow of air 86 to the annular cavity 224 of the combustion chamber 222. The inner flange 216 defines a first protrusion 234 extending into the airflow opening 232, and the outer flange 220 defines a second protrusion 236 extending into the airflow opening 232 opposite the first protrusion 234. Together, the first and second protrusions 234, 236 define an air chute 236 for generating a vortex of air within the annular cavity 224. The exemplary assembly method further comprises machining the first protrusion 234 and/or the second protrusion 236 such that the air chute 236 has a predetermined width W. For instance, the inner liner 202 and the outer liner 204, which includes combustor dome 214 and outer flange 220, may be formed from a CMC material. The first and second protrusions 234, 236 may be formed from a buildup of CMC plies, e.g., a CMC ply stack or a plurality of CMC plies laid up with the CMC material forming the inner liner 202 and the outer liner 204, respectively. The buildup on the inner flange 216 may be machined to define first protrusion 234 and/or to define the width W of the air chute 236. Similarly, the buildup on the outer flange 220 may be machined to define second protrusion 236 and/or to define the width of the air chute 236.

The foregoing methods are provided by way of example only. The exemplary combustor assemblies 100, 200 described with respect to FIGS. 2-7 may be assembled using any suitable method or by performing any of the steps recited above in another appropriate order. The assembly method and/or order of the assembly method steps may be selected to best facilitate the assembly of the particular combustor assembly, e.g., the assembly method may vary depending on whether the combustor is tilted or is generally aligned along the axial direction A as previously described.

As previously described, the inner liner 102 and outer liner 104, as well as the inner liner 202 and outer liner 204, may be formed from a ceramic matrix composite (CMC) material, which is a non-metallic material having high temperature capability. In some embodiments, the combustor dome 114 and combustor dome 214 also are formed from a CMC material. More particularly, the combustor dome 114 may be integrally formed with the inner liner 102 from a CMC material, such that the combustor dome 114 and the inner liner 102 are a single piece. Moreover, the combustor dome 214 may be integrally formed with the outer liner 204 from a CMC material, such that the combustor dome 214 and outer liner 204 are a single piece. In other embodiments, the combustor dome 114 and combustor dome 214 are formed separately from the inner and outer liners, e.g., from a metallic material such as a metal or metal alloy. Further, the chute member 134 also may be formed from a CMC material, either as a single piece annular structure or from a plurality of chute member segments that together form an annular chute member 134. As described above, fuel and air mix and are ignited within each of the combustor assemblies 100, 200, where it may be particularly useful to utilize CMC materials due to the relatively high temperatures of the combustion gases 66. However, other components of turbofan engine 10, such as components of HP compressor 24, HP turbine 28, and/or LP turbine 30, also may comprise a CMC material.

Exemplary CMC materials utilized for such components may include silicon carbide (SiC), silicon, silica, or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y, and combinations thereof) and inorganic fillers (e.g., pyrophyllite, wollastonite, mica, talc, kyanite, and montmorillonite). For example, in certain embodiments, bundles of the fibers, which may include a ceramic refractory material coating, are formed as a reinforced tape, such as a unidirectional reinforced tape. A plurality of the tapes may be laid up together (e.g., as plies) to form a preform component. The bundles of fibers may be impregnated with a slurry composition prior to forming the preform or after formation of the preform. The preform may then undergo thermal processing, such as a cure or burn-out to yield a high char residue in the preform, and subsequent chemical processing, such as melt-infiltration or chemical vapor infiltration with silicon, to arrive at a component formed of a CMC material having a desired chemical composition. In other embodiments, the CMC material may be formed as, e.g., a carbon fiber cloth rather than as a tape.

More specifically, examples of CMC materials, and particularly SiC/Si—SiC (fiber/matrix) continuous fiber-reinforced ceramic composite (CFCC) materials and processes, are described in U.S. Pat. Nos. 5,015,540; 5,330,854; 5,336,350; 5,628,938; 6,024,898; 6,258,737; 6,403,158; and 6,503,441, and U.S. Patent Application Publication No. 2004/0067316. Such processes generally entail the fabrication of CMCs using multiple pre-impregnated (prepreg) layers, e.g., the ply material may include prepreg material consisting of ceramic fibers, woven or braided ceramic fiber cloth, or stacked ceramic fiber tows that has been impregnated with matrix material. In some embodiments, each prepreg layer is in the form of a "tape" comprising the desired ceramic fiber reinforcement material, one or more precursors of the CMC matrix material, and organic resin binders. Prepreg tapes can be formed by impregnating the reinforcement material with a slurry that contains the ceramic precursor(s) and binders. Preferred materials for the precursor will depend on the particular composition desired for the ceramic matrix of the CMC component, for example, SiC powder and/or one or more carbon-containing materials if the desired matrix material is SiC. Notable carbon-containing materials include carbon black, phenolic resins, and furanic resins, including furfuryl alcohol ($C_4H_3OCH_2OH$). Other typical slurry ingredients include organic binders (for example, polyvinyl butyral (PVB)) that promote the flexibility of prepreg tapes, and solvents for the binders (for example, toluene and/or methyl isobutyl ketone (MIBK)) that promote the fluidity of the slurry to enable impregnation of the fiber reinforcement material. The slurry may further contain one or more particulate fillers intended to be present in the ceramic matrix of the CMC component, for example, silicon and/or SiC powders in the case of a Si—SiC matrix. Chopped fibers or whiskers or other materials also may be embedded within the matrix as previously described. Other compositions and processes for producing composite articles, and more specifically, other slurry and prepreg tape compositions, may be used as well, such as, e.g., the processes and compositions described in U.S. Patent Application Publication No. 2013/0157037.

The resulting prepreg tape may be laid-up with other tapes, such that a CMC component formed from the tape comprises multiple laminae, each lamina derived from an individual prepreg tape. Each lamina contains a ceramic fiber reinforcement material encased in a ceramic matrix formed, wholly or in part, by conversion of a ceramic matrix precursor, e.g., during firing and densification cycles as described more fully below. In some embodiments, the reinforcement material is in the form of unidirectional arrays of tows, each tow containing continuous fibers or filaments. Alternatives to unidirectional arrays of tows may be used as well. Further, suitable fiber diameters, tow diameters, and center-to-center tow spacing will depend on the particular application, the thicknesses of the particular lamina and the tape from which it was formed, and other factors. As described above, other prepreg materials or non-prepreg materials may be used as well.

After laying up the tapes or plies to form a layup, the layup is debulked and, if appropriate, cured while subjected to elevated pressures and temperatures to produce a preform. The preform is then heated (fired) in a vacuum or inert atmosphere to decompose the binders, remove the solvents, and convert the precursor to the desired ceramic matrix material. Due to decomposition of the binders, the result is a porous CMC body that may undergo densification, e.g., melt infiltration (MI), to fill the porosity and yield the CMC component. Specific processing techniques and parameters for the above process will depend on the particular composition of the materials. For example, silicon CMC components may be formed from fibrous material that is infiltrated with molten silicon, e.g., through a process typically referred to as the Silcomp process. Another technique of manufacturing CMC components is the method known as the slurry cast melt infiltration (MI) process. In one method of manufacturing using the slurry cast MI method, CMCs are produced by initially providing plies of balanced two-dimensional (2D) woven cloth comprising silicon carbide (SiC)-containing fibers, having two weave directions at substantially 90° angles to each other, with substantially the same number of fibers running in both directions of the weave. The term "silicon carbide-containing fiber" refers to a fiber having a composition that includes silicon carbide, and preferably is substantially silicon carbide. For instance, the fiber may have a silicon carbide core surrounded with carbon, or in the reverse, the fiber may have a carbon core surrounded by or encapsulated with silicon carbide.

Other techniques for forming CMC components include polymer infiltration and pyrolysis (PIP) and oxide/oxide processes. In PIP processes, silicon carbide fiber preforms are infiltrated with a preceramic polymer, such as polysilazane and then heat treated to form a SiC matrix. In oxide/oxide processing, aluminum or alumino-silicate fibers may be pre-impregnated and then laminated into a preselected geometry. Components may also be fabricated from a carbon fiber reinforced silicon carbide matrix (C/SiC) CMC. The C/SiC processing includes a carbon fibrous preform laid up on a tool in the preselected geometry. As utilized in the slurry cast method for SiC/SiC, the tool is made up of graphite material. The fibrous preform is supported by the tooling during a chemical vapor infiltration process at about 1200° C., whereby the C/SiC CMC component is formed. In still other embodiments, 2D, 2.5D, and/or 3D preforms may be utilized in MI, CVI, PIP, or other processes. For example, cut layers of 2D woven fabrics may be stacked in alternating weave directions as described above, or filaments may be wound or braided and combined with 3D weaving, stitching, or needling to form 2.5D or 3D preforms having multiaxial fiber architectures. Other ways of forming 2.5D or 3D preforms, e.g., using other weaving or braiding methods or utilizing 2D fabrics, may be used as well.

Thus, a variety of processes may be used to form a CMC inner liner 102, which may include combustor dome 114; a CMC outer liner 104; a CMC inner liner 202; a CMC outer liner 204, which may include combustor dome 214; and a CMC chute member 134. Of course, other suitable processes, including variations and/or combinations of any of the processes described above, also may be used to form CMC components for use with the various combustor assembly embodiments described herein.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A combustor assembly, comprising:

an annular inner liner extending generally along an axial direction;

an annular outer liner extending generally along the axial direction, the outer liner including an outer flange extending forward from an upstream end of the outer liner;

a combustor dome extending between an upstream end of the inner liner and the upstream end of the outer liner, the combustor dome including an inner flange extending forward from a radially outermost end of the combustor dome;

a chute member; and an attachment member, wherein the inner liner, the outer liner, and the combustor dome define a combustion chamber therebetween, wherein the combustor dome and a portion of the outer liner together define an annular cavity of the combustion chamber, wherein the inner flange and the outer flange define an airflow opening therebetween, wherein the chute member is positioned between the inner flange and the outer flange within the airflow opening to define an air chute for providing a flow of air to the annular cavity, and wherein the attachment member extends through the outer flange, the chute member, and the inner flange.

2. The combustor assembly of claim 1, wherein the outer liner includes a first wall extending at least partially along the axial direction;

a second wall extending at least partially along the axial direction; and a transition wall extending from the first wall to the second wall and coupling the first wall and the second wall, wherein the first wall is disposed radially outward of the second wall.

3. The combustor assembly of claim 2, wherein the combustor dome, the first wall of the outer liner, and the transition wall of the outer liner together define the annular cavity of the combustion chamber.

4. The combustor assembly of claim 1, wherein the outer liner and the inner liner are formed from a ceramic matrix composite (CMC) material.

5. The combustor assembly of claim 4, wherein the combustor dome is integrally formed with the inner liner from the CMC material.

6. The combustor assembly of claim 4, wherein the combustor dome is formed from a metallic material.

7. The combustor assembly of claim 1, wherein the inner flange defines a protrusion within the airflow opening, the protrusion and the chute member together defining the air chute.

8. The combustor assembly of claim 1, further comprising:

an airflow tube extending into an opening in the combustor dome radially inward of the annular cavity.

9. The combustor assembly of claim 1, further comprising:

a plurality of attachment members extending through the outer flange, the chute member, and the inner flange; and a plurality of grommets, one of the plurality of grommets positioned between the outer flange and each of the plurality of attachment members, one of the plurality of grommets positioned between the chute member and each of the plurality of attachment members, and one of the plurality of grommets positioned between the inner flange and each of the plurality of attachment members, wherein the grommets positioned between the outer flange and each of the plurality of attachment members alternate in a repeating pattern between being in contact with and spaced apart from the attachment members, wherein the grommets positioned between the chute member and each of the plurality of attachment members alternate in a repeating pattern between being in contact with and spaced apart from the attachment members, and wherein the grommets positioned between the inner flange and each of the plurality of attachment members alternate in a repeating pattern between being in contact with and spaced apart from the attachment members.

10. The combustor assembly of claim 1, wherein the chute member is repositionable with respect to the outer flange and the inner flange.

11. The combustor assembly of claim 1, wherein the chute member is radially aligned with both the inner flange and the outer flange.

12. A combustor assembly, comprising:

an annular inner liner extending generally along an axial direction, the inner liner including an inner flange extending forward from an upstream end of the inner liner;

an annular outer liner extending generally along the axial direction; and a combustor dome extending between the upstream end of the inner liner and an upstream end of the outer liner, the combustor dome including an outer flange extending forward from a radially innermost end of the combustor dome, wherein the inner liner, the outer liner, and the combustor dome define a combustion chamber therebetween, wherein the combustor dome and a portion of the inner liner together define an annular cavity of the combustion chamber, wherein the inner flange and the outer flange define an airflow opening therebetween, and wherein the inner flange defines a first protrusion extending radially into the airflow opening, the outer flange defines a second protrusion extending radially into the airflow opening such that the first protrusion and the second protrusion are radially aligned, the first and second protrusions defining an air chute for providing a flow of air to the annular cavity, the first annular cavity adjacent the air chute.

13. The combustor assembly of claim 12, wherein the inner liner includes a first wall extending at least partially along the axial direction;

a second wall extending at least partially along the axial direction; and a transition wall extending from the first wall to the second wall and coupling the first wall and the second wall, wherein the first wall is disposed radially inward of the second wall, and wherein the combustor dome, the first wall of the inner liner, and the transition wall of the inner liner together define the annular cavity of the combustion chamber.

14. The combustor assembly of claim 12, wherein the outer liner and the inner liner are formed from a ceramic matrix composite (CMC) material.

15. The combustor assembly of claim 14, wherein the combustor dome is integrally formed with the outer liner from the CMC material.

16. The combustor assembly of claim 15, wherein the first protrusion is formed from a stack of plies of the CMC material, and wherein the second protrusion is formed from a stack of plies of the CMC material.

17. The combustor assembly of claim 12, further comprising:

an airflow tube extending into an opening in the combustor dome radially outward of the annular cavity.

18. A method for assembling a combustor assembly of a gas turbine engine, comprising:

inserting an annular inner liner within the gas turbine engine, the inner liner including an inner flange extending forward from an upstream end of the inner liner;

inserting an annular outer liner within the gas turbine engine, the outer liner circumferentially surrounding the inner liner, the outer liner including an outer flange extending forward from an upstream end of the outer liner, the inner liner and the outer liner defining a combustion chamber therebetween, the combustion chamber having an annular cavity, the inner flange and the outer flange defining an airflow opening therebetween for providing a flow of air to the annular cavity of the combustion chamber, the airflow opening having a width; and after inserting both the inner liner and the outer liner, positioning a chute member within the airflow opening to define an air chute for generating a vortex of air within the annular cavity, the chute member reducing the width of the airflow opening between the inner flange and the outer flange.

19. The method of claim 18, wherein the chute member is a single piece, annular structure.

20. The method of claim 18, wherein the chute member comprises a plurality of chute member segments, and wherein the plurality of chute member segments together form an annular chute member.

* * * * *